US009713359B2

(12) United States Patent
Ko et al.

(10) Patent No.: US 9,713,359 B2
(45) Date of Patent: Jul. 25, 2017

(54) SHOE BODY WITH ARCH SUSPENDED SUPPORT

(71) Applicant: Yu Hsieh Industrial Co., Ltd., Taichung (TW)

(72) Inventors: Chih-Yung Ko, Taichung (TW); Yu-Lin Ko, Taichung (TW); Yu-Tseng Ko, Taichung (TW)

(73) Assignee: Yu Hsieh Industrial Co., Ltd., Taichung (TW)

( * ) Notice: Subject to any disclaimer, the term of this patent is extended or adjusted under 35 U.S.C. 154(b) by 35 days.

(21) Appl. No.: 14/705,156

(22) Filed: May 6, 2015

(65) Prior Publication Data

US 2016/0324257 A1 Nov. 10, 2016

(51) Int. Cl.

| | |
|---|---|
| ***A43B 3/00*** | (2006.01) |
| ***A43B 7/14*** | (2006.01) |
| ***A43B 13/14*** | (2006.01) |
| ***A43C 11/14*** | (2006.01) |

(52) U.S. Cl.

CPC ..... *A43B 7/1495* (2013.01); *A43B 3/0073* (2013.01); *A43B 13/145* (2013.01); *A43C 11/1493* (2013.01)

(58) Field of Classification Search

CPC ... A43B 3/0052; A43B 3/0073; A43B 7/1495; A43B 7/28; A43B 23/02; A43C 5/00; A43C 11/14; A43C 11/1493

USPC ..... 36/91, 93, 50.1, 53, 170

See application file for complete search history.

(56) References Cited

U.S. PATENT DOCUMENTS

| | | | | | |
|---|---|---|---|---|---|
| 1,650,000 | A | * | 11/1927 | Young | A43B 3/101 36/1 |
| 2,099,436 | A | * | 11/1937 | Donovan | A43B 7/1495 36/170 |
| 2,149,664 | A | * | 3/1939 | Brown | A43B 7/1495 36/170 |
| 3,522,668 | A | * | 8/1970 | Fesl | A43B 7/1495 36/117.9 |
| 4,550,511 | A | * | 11/1985 | Gamm | A43B 7/1495 36/117.9 |
| 4,860,464 | A | * | 8/1989 | Misevich | A43B 7/1495 36/114 |
| 5,269,078 | A | * | 12/1993 | Cochrane | A43B 5/00 36/170 |

(Continued)

FOREIGN PATENT DOCUMENTS

| | | | | |
|---|---|---|---|---|
| GB | 527235 | A | * 10/1940 | A43B 7/1495 |

*Primary Examiner* — Sharon M Prange

(74) *Attorney, Agent, or Firm* — C. G. Mersereau; Nikolai & Mersereau, P.A.

(57) ABSTRACT

A shoe body comprises an outsole, a midsole, a vamp, a first girdle and a second girdle. A lower edge of the vamp extends from a periphery to a bottom surface of the midsole, and is connected between the midsole and the outsole. The first girdle has a bottom end formed with two fork pieces so that end portions of the fork pieces are fixed to a side edge of the midsole, and a top end going from one side of an arch portion of a foot bottom to a location above an instep. The second girdle has a bottom end fixed to the other side edge of the midsole, and a top end of the second girdle passing through the two fork pieces of the first girdle and then going from the other side of the arch portion of the foot bottom to a location above the instep.

6 Claims, 7 Drawing Sheets

(56) References Cited

U.S. PATENT DOCUMENTS

| | | | | | |
|---|---|---|---|---|---|
| 5,323,549 | A * | 6/1994 | Segel | A43B 7/1495 | 36/140 |
| 5,564,203 | A * | 10/1996 | Morris | A43C 11/00 | 36/136 |
| 5,819,439 | A * | 10/1998 | Sanchez | A43B 5/00 | 36/50.1 |
| 6,393,733 | B1 * | 5/2002 | London | A43B 7/1495 | 36/155 |
| 6,745,500 | B2 * | 6/2004 | Suzuki | A43C 11/1493 | 36/50.1 |
| 6,772,541 | B1 * | 8/2004 | Ritter | A43B 7/14 | 36/50.1 |
| 6,775,929 | B2 * | 8/2004 | Katz | A43C 11/14 | 36/114 |
| 6,925,734 | B1 * | 8/2005 | Schaeffer | A43B 7/1495 | 36/166 |
| 7,490,417 | B2 * | 2/2009 | Petrie | A43C 11/008 | 36/170 |
| 8,375,602 | B2 * | 2/2013 | Takada | A43C 1/00 | 36/50.1 |
| 2004/0134100 | A1 * | 7/2004 | McVicker | A43B 1/0081 | 36/50.1 |
| 2006/0117606 | A1 * | 6/2006 | Chen | A43B 7/223 | 36/50.1 |
| 2009/0277043 | A1 * | 11/2009 | Graser | A43B 7/1495 | 36/91 |
| 2013/0192091 | A1 * | 8/2013 | Kohatsu | A43B 23/026 | 36/103 |

* cited by examiner

SHOE BODY WITH ARCH SUSPENDED SUPPORT

BACKGROUND OF THE INVENTION (1) Field of the Invention

The invention relates to the technical field of a shoe body structure for supporting an arch, and more particularly to a shoe body with an arch suspended support, in which two girdles are used to form a large-area support of an X-shaped frame formed on a portion of the arch of the foot bottom, and top ends of the two girdles go from two sides of the foot to the instep and then are overlapped with and connected to each other, so that the top portion of the X-shaped frame forms a suspended covering state. Thus, when a force is exerted on the sole, it is possible to prevent the skeleton of the arch portion from excessively expanding. When no force is exerted on the sole, the skeleton of the arch portion can be indeed restored so that the arch can be effectively protected and the wearing comfort can be enhanced.

(2) Description of the Prior Art

The bottom of the human's body sole has a concave arch portion. Thus, when the person is performing activities, such as walking, running, jumping and the like, and the sole steps on the ground, the buffer effect is achieved using the arc change of the arch portion. However, if the sole withstands the pressure for a long period of time or withstands the higher pressure, then the arch portion tends to excessively expand to cause shifting of the sole skeleton, which cannot be recovered. Thus, the subsequent buffer effect of the arch portion is affected, and the pain of the sole is caused. Furthermore, other portions of the body may even be incidentally affected to cause the uncomfortable feeling, such as aches.

To solve the above-mentioned problems, some manufacturers have developed a shoe pad structure, in which a plastic material is mainly used to integrally form jointly with a shoe pad with a little resilience, wherein the shoe pad may be placed at an arch of a foot bottom, and a top surface of the shoe pad is configured to match with the curved camber of the arch portion. Thus, when the shoe pad is placed in the shoe, the shoe pad can support the arch portion. When the sole is withstanding the pressure, the resilient deformation force of the shoe pad can be utilized to provide the buffer effect, so that the skeleton structure of the sole is held at the normal position. However, the shoe pad structure only can let the arch portion of the bottom of the sole naturally press against the top surface thereof, and cannot cover the foot. Thus, when various activities are being performed, the lateral force of the foot tends to separate the arch portion of the bottom surface of the sole from the shoe pad, thereby affecting the effect of providing the buffering to restore the sole skeleton. More particularly, the top surface of the shoe pad has the fixed arc, and the shoe pad is not applicable to all users. In addition, the shoe pad integrally formed by the plastic material has the considerable hardness, which tends to make the user's foot bottom feel uncomfortable.

SUMMARY OF THE INVENTION

The conventional shoe pad for supporting the arch has many drawbacks that the shoe pad tends to be separated from the arch portion and affects the buffer supporting effect, that the shoe pad has the high hardness and poor comfort, and that the shoe pad has the fixed shape and is not applicable to various users.

The invention provides a shoe body with an arch suspended support comprising an outsole, a midsole, a vamp, a first girdle and a second girdle. The midsole is connected to a top surface of the outsole. A user's foot is placed into the vamp. A lower edge of the vamp extends from a periphery of the midsole to a bottom surface of the midsole, and is connected between the midsole and the outsole. A bottom end of the first girdle is formed with two fork pieces so that an overall structure has a substantial Y-shape, end portions of the two fork pieces are fixed to a side edge of the midsole, a top end of the first girdle may go from one side of an arch portion of a foot bottom to a location above an instep, and a third sticky piece is disposed on an outer surface of the first girdle. The second girdle is in a form of a long sheet. A bottom end of the second girdle is fixed to the other side edge of the midsole, a top end of the second girdle passes through the two fork pieces of the first girdle and then goes from the other side of the arch portion of the foot bottom to a location above the instep, and a fourth sticky piece to be stuck with the third sticky piece is disposed on an inner surface of a top end portion of the second girdle.

The shoe body with an arch suspended support of the invention can make the first and second girdles form the X-shaped frame on the portion of the arch of the foot bottom to form the good support. In addition, the top ends of the first and second girdles go to the location above the instep from two sides and then are overlapped with each other, so that the top portion of the X-shaped frame forms the state of suspending and covering the foot. Thus, when the force is exerted on the sole, it is possible to prevent the skeleton of the arch portion from excessively expanding. When no force is exerted on the sole, the skeleton of the arch portion can indeed restore, thereby achieving the effects of effectively protecting the arch and enhancing the comfort upon wearing. In addition, the top ends of the first and second girdles go from two sides of the foot to the location above the instep and are then overlapped with and stuck with each other, so that the foot forms the suspended covering state, and the arch portion of the bottom of the sole cannot leave the support of the X-shaped frame no matter which lateral force is exerted in activities. More particularly, the bottom end of the first girdle is formed with two fork pieces so that the overall structure is in the form of a Y-shape, and the second girdle passes through the location between the two fork pieces of the first girdle to form the overlapped shape. This further makes the X-shaped frame have the larger supporting surface area and the larger supporting force, and can further enhance the supporting effect thereof. In addition, the structure formed when the top ends of the first and second girdles go to the location above the instep and are then overlapped with and stuck to each other further makes the X-shaped frame have the sufficient suspension force. In addition, the support height and tightness thereof may also be adjusted by different users.

DETAILED DESCRIPTION OF THE PREFERRED EMBODIMENTS

Figure 1:
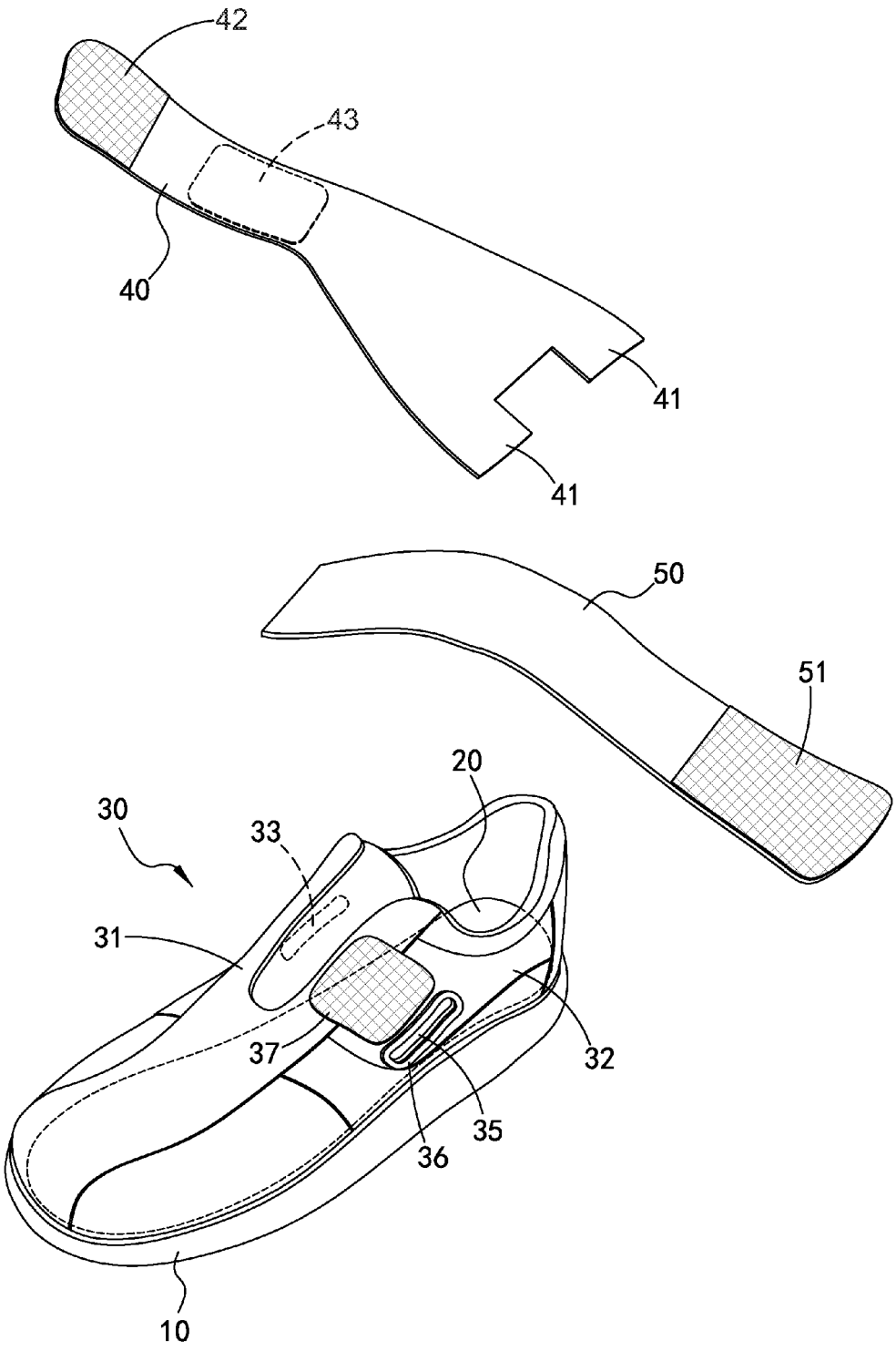
FIG. 1 is a pictorially decomposed schematic view showing the invention.

Referring to FIGS. 1 to 6, a shoe body with an arch suspended support according to the invention comprises an outsole 10, a midsole 20, a vamp 30, a first girdle 40 and a second girdle 50.

The outsole 10 has a bottom surface formed with front and rear ends, which are low, and a high middle to form a convex arc shape.

The midsole 20 is connected to a top surface of the outsole 10.

A user's foot 70 may be placed into the vamp 30. A lower edge of the vamp 30 extends from a periphery of the midsole 20 to a bottom surface of the midsole 20 and is connected between the midsole 20 and the outsole 10. The vamp 30 comprises a first sidewall 31 and a second sidewall 32 covering two sides of the foot 70. The first sidewall 31 has a first through hole 33 penetrating therethrough. A hole edge of the first through hole 33 is connected to a first reinforcement member 34 to strengthen the structural strength of the hole wall of the first through hole 33. The second sidewall 32 has a second through hole 35 penetrating therethrough. A hole edge of the second through hole 35 is connected to a second reinforcement member 36 to strengthen the structural strength of the hole wall of the second through hole 35. An outer surface of the second sidewall 32 is connected to a first sticky piece 37.

A bottom end of the first girdle 40 is formed with two fork pieces 41 so that the overall structure has a substantial Y-shape. End portions of the two fork pieces 41 are fixed to a side edge of a top surface of the midsole 20 close to the second sidewall 32 by way of sewing. The top end of the first girdle 40 may also pass through one side of an arch portion 71 of the foot bottom and then extends outside the first sidewall 31 from the first through hole 33. An inner surface of a top end portion of the first girdle 40 is sewed with a second sticky piece 42 to be stuck with the first sticky piece 37. The outer surface of the portion of the first girdle 40 extending outside the first sidewall 31 is sewed with a third sticky piece 43.

The second girdle 50 is in a form of a long sheet and has a bottom end fixed to a side edge of a top surface of the midsole 20 close to the first sidewall 31 by way of sewing. The top end of the second girdle 50 passes through a location between two fork pieces 41 of the first girdle 40 and then extends outside the second sidewall 32 from the other side of the arch portion 71 of the foot bottom through the second through hole 35, wherein an inner surface of the top end portion of the second girdle 50 is sewed with a fourth sticky piece 51 to be stuck with the third sticky piece 43.

Figure 2:
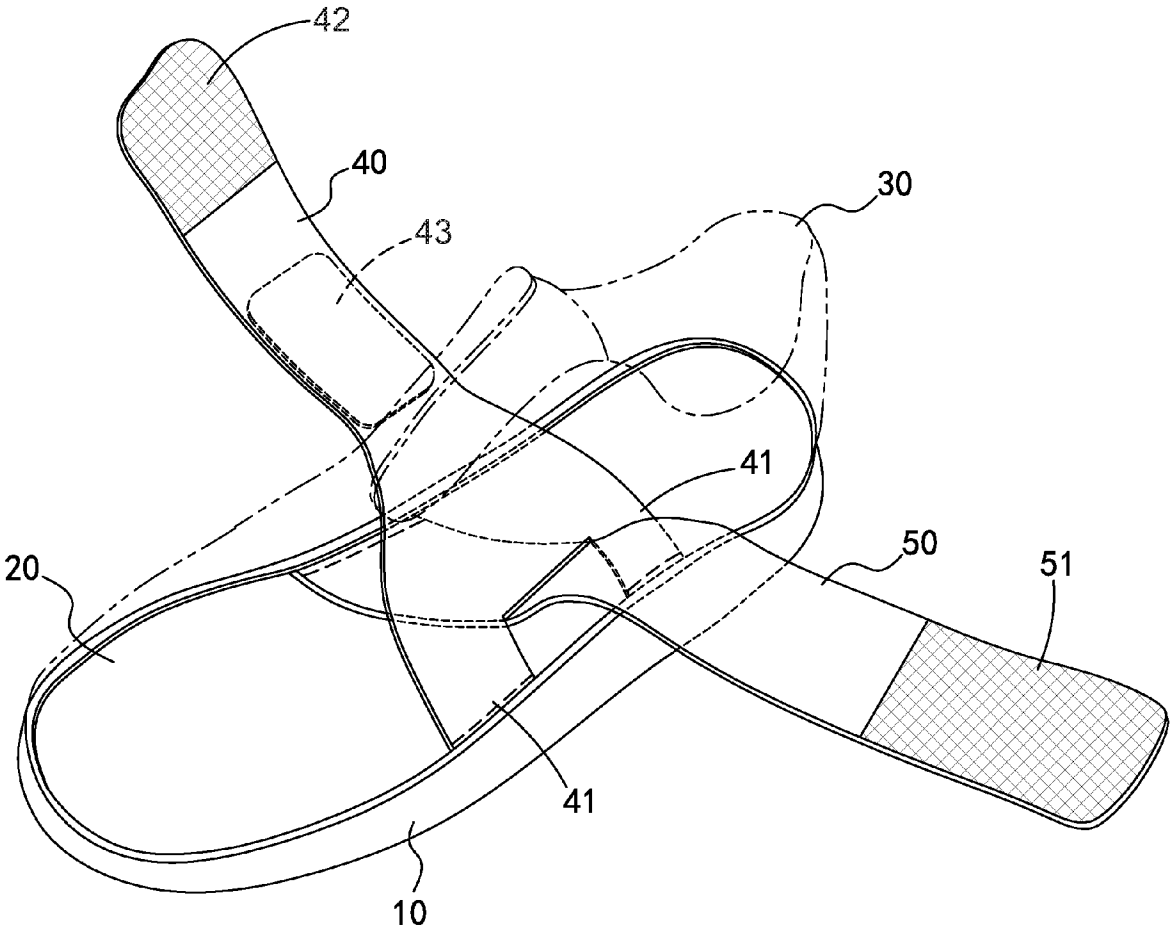
FIG. 2 is a schematic view showing a fixed state between first and second girdles and a midsole of the invention.
Figure 3:
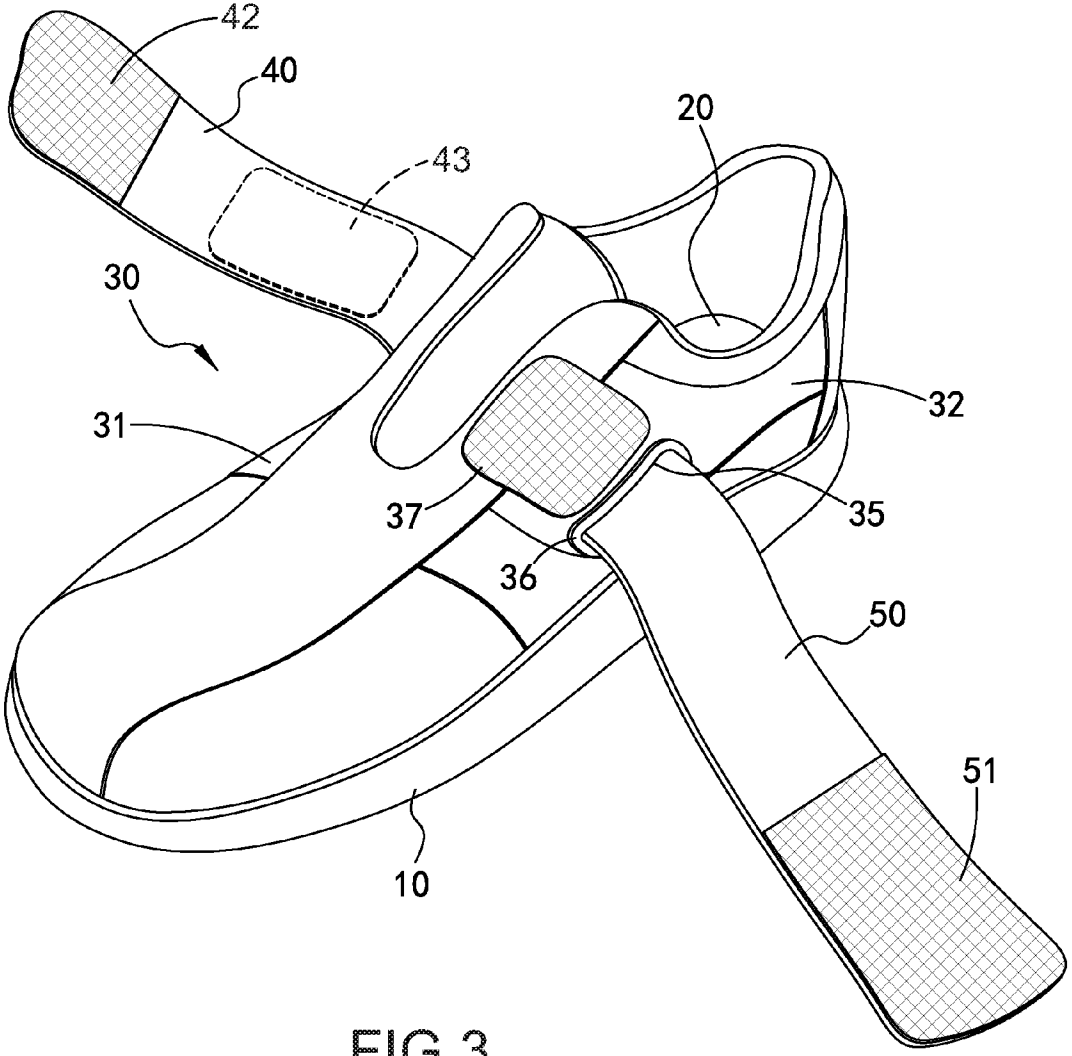
FIG. 3 is a pictorially assembled schematic view showing the invention, wherein the first and second girdles are not stuck together.
Figure 4:
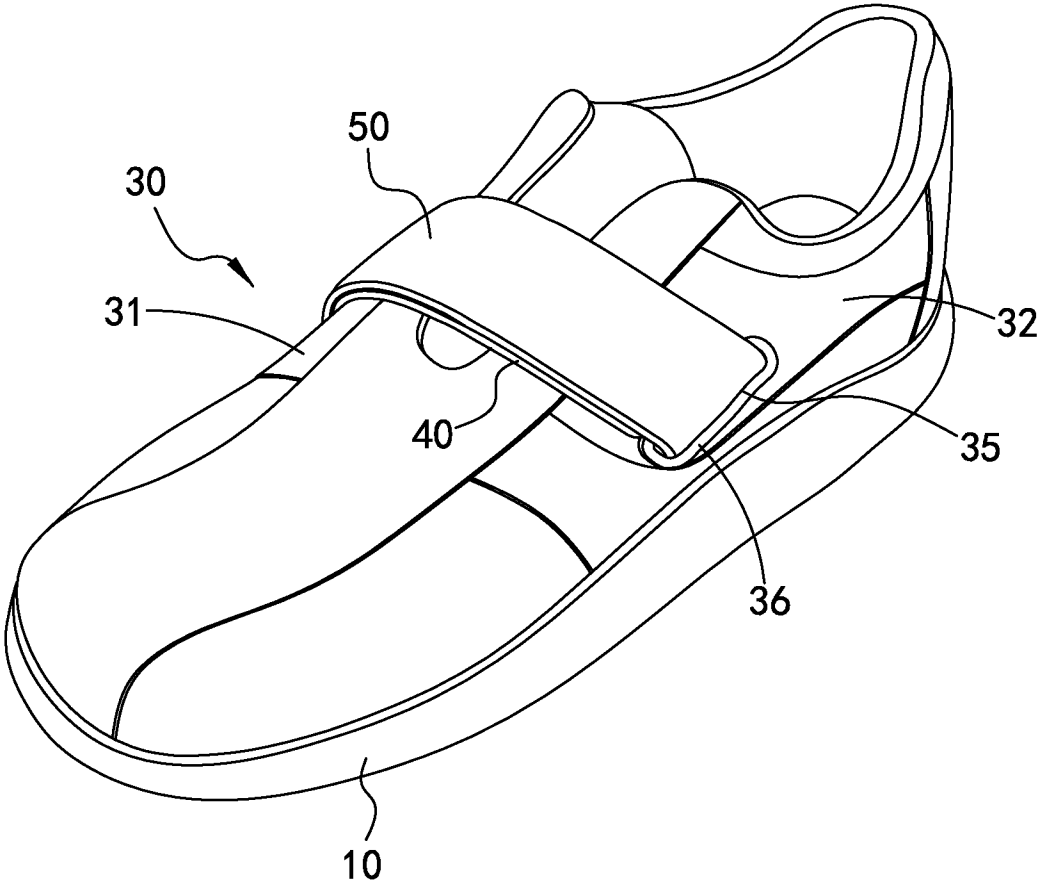
FIG. 4 is a pictorially assembled schematic view showing the invention, wherein first and second girdles are stuck together.
Figure 5:
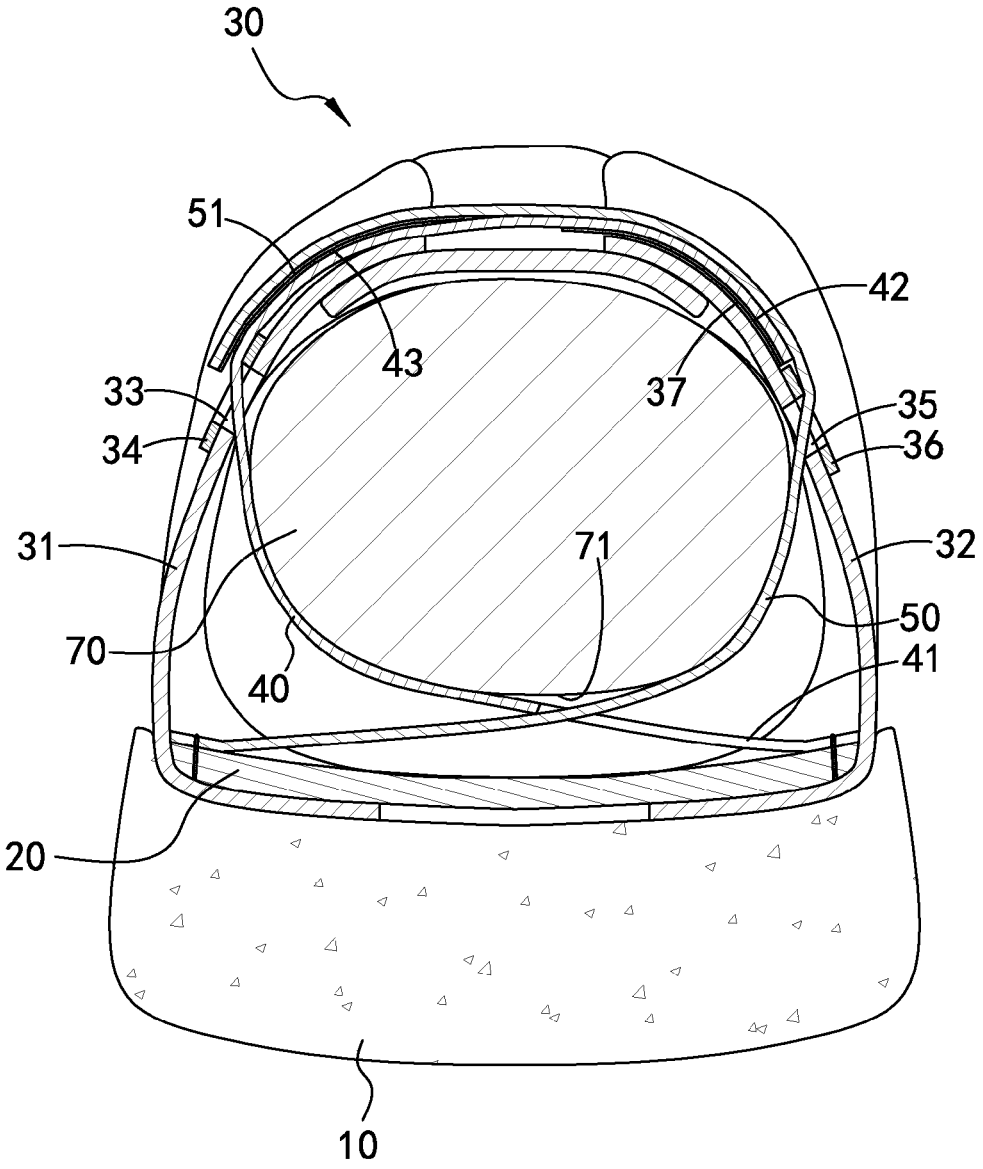
FIG. 5 is a transversally schematic cross-sectional view showing a used state of the invention.
Figure 6:
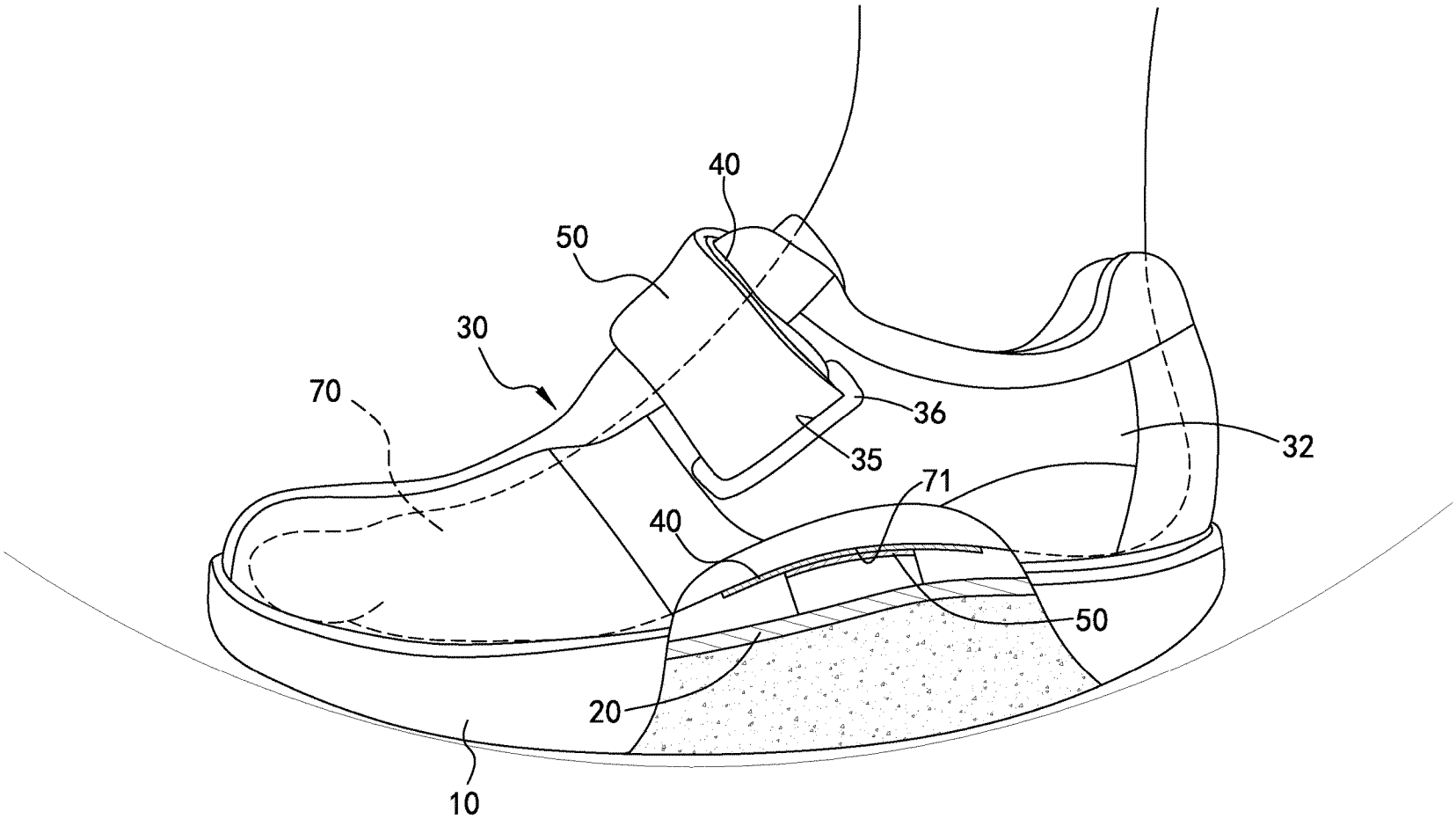
FIG. 6 is a longitudinally partial schematic view showing the used state of the invention.

In FIGS. 2, 5 and 6, after the user places the foot 70 into the vamp 30, the user can pull the first girdle 40 and the second girdle 50 outwards, then stick the second sticky piece 42 of the first girdle 40 to the first sticky piece 37 of the second sidewall 32, and then stick the fourth sticky piece 51 of the second girdle 50 to the third sticky piece 43 of the first girdle 40. Thus, the first and second girdles 40, 50 form an X-shaped frame below the arch portion 71 of the foot bottom to form a good support. The top ends of the first and second girdles 40, 50 go to the top of the instep from two sides of the foot 70 and are then overlapped with and stuck with each other to form a state where a top portion of the X-shaped frame is suspended to cover the foot 70. Thus, when a force is exerted on the sole, it is possible to prevent the skeleton of the arch portion 71 from excessively expanding. When no force is exerted on the sole, it is also possible to make the skeleton of the arch portion 71 be indeed restored, thereby achieving the effect of effectively protecting the arch and enhancing the wearing comfort. In addition, the top ends of the first and second girdles 40, 50 go to the location above the instep from two sides of the foot 70 and are then overlapped with and stuck to each other to form a state where the foot 70 is covered. Thus, when the foot moves, the arch portion 71 on the bottom of the sole will not leave the support of the X-shaped frame no matter which lateral force is exerted on the foot. More particularly, two fork pieces 41 are formed on the bottom end of the first girdle 40 so that the overall structure has the Y shape, and the second girdle 50 passes through the location between the two fork pieces 41 of the first girdle 40 to form the overlapping structure design. This also makes the X-shaped frame have the larger supporting surface area and the larger supporting force, thereby further providing the supporting effect. In addition, the top ends of the first and second girdles 40, 50 go to the location above the instep and are then overlapped with each other. This structure further makes the X-shaped frame have the sufficient suspension force. The supporting height and tightness thereof may also be easily adjusted for different users. In addition, the tightening of the first and second girdles 40, 50 eliminates the use of the shoelaces.

In FIG. 6, when the user wears the shoe body with an arch suspended support according to the invention to walk and the heel touches the ground at the beginning of walking, the design of the convex arc shape of the bottom surface of the outsole 10 makes the tiptoe uptilt, so that the muscles between the calf and the thigh are relatively unfolded, and the body-building effect, such as stretching and weight loss, can be obtained. When the user keeps walking forwards with the center of gravity moving frontward, the outsole 10 swings along the bottom surface of the convex arc shape thereof. Before the outsole 10 leaves the ground, the contact point between the outsole 10 and the ground moves frontward to the tiptoe. Correspondingly, the design of the convex arc shape of the bottom surface of the outsole 10 makes the heel be lifted naturally, so that the effect of stretching the muscles of the calf is obtained. Therefore, the shoe body with an arch suspended support according to the invention makes the walking wearer enter a naturally unstable state according to the design of the convex arc shape of the bottom surface of the outsole 10, and the human body unconsciously generates the action of balancing the rhythm in the unstable state, so the more force exerting effects can be generated. Thus, the dormant muscles are imperceptibly pulled to activate the long-term ignored muscle group, the body can naturally enter the straight state, and the gait thus satisfies the biomechanics to achieve the objects of chest out, stomach in and hip up. Furthermore, the portions, which cannot be easily and often used, can be pulled and lifted, so that the posture becomes firmer, and the body curve can be sculptured.

The vamp 30 of the shoe body with an arch suspended support according to the invention may also be a hollow vamp composed of a plurality of strips of sheet bodies, so that the shoe body as a whole is in the state of a sandal. In this manner, the first and second through holes 33, 35 need not to be formed on the vamp 30, and the first and second girdles 40, 50 are directly overlapped and stuck with each other above the instep.

Figure 7:
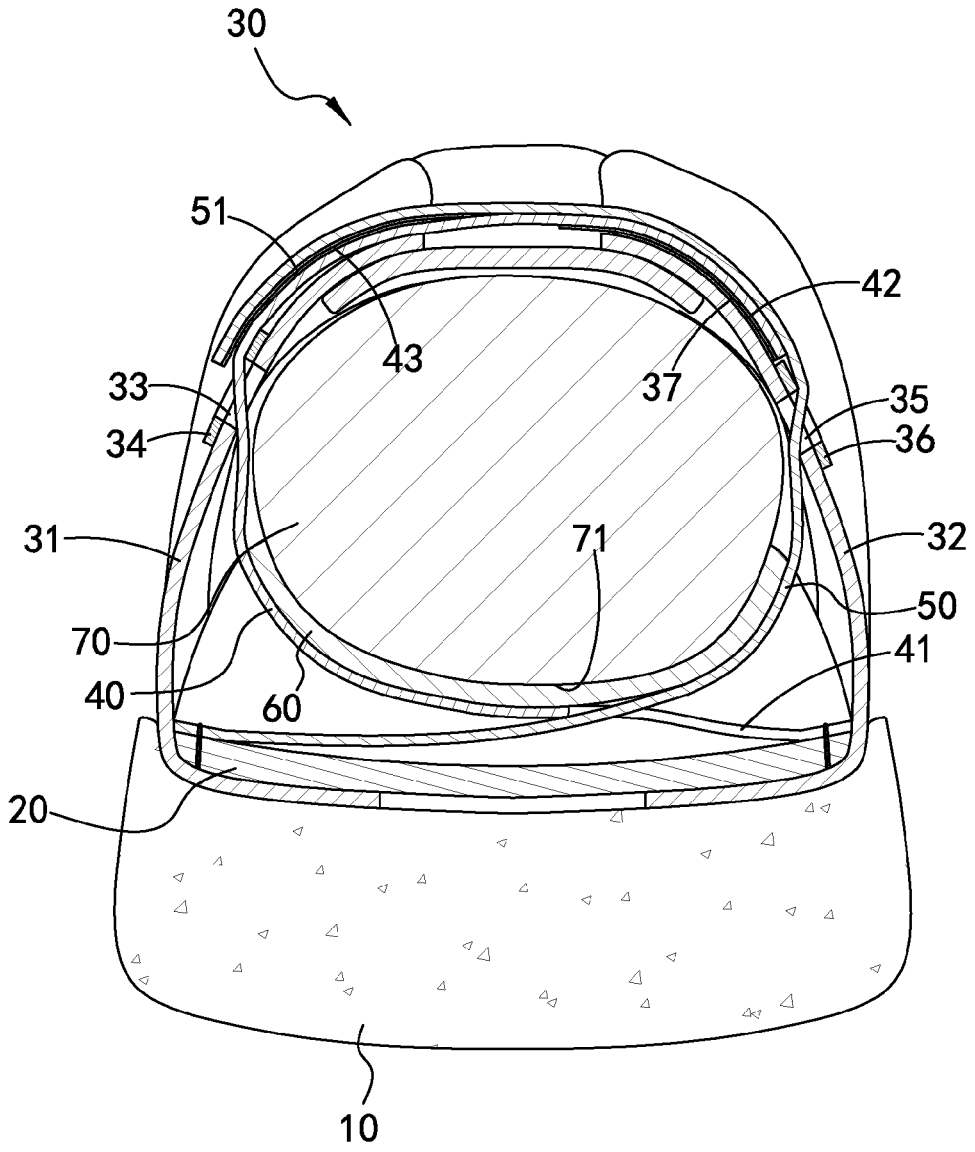
FIG. 7 shows another embodiment of the invention.

Referring to FIG. 7, the structure of another embodiment of the invention is substantially the same as that of the above-mentioned embodiment except for the difference that the shoe body with an arch suspended support according to this embodiment further comprises a shoe pad 60. The shoe pad 60 is disposed in the vamp 30 and above the overlapped portion between the first and second girdles 40, 50, so that the sole upon wearing feels more comfortable.

What is claimed is:

1. A shoe body with an arch suspended support, the shoe body comprising:

an outsole;

a midsole connected to a top surface of the outsole;

a vamp, wherein a lower edge of the vamp extends from a periphery of the midsole to a bottom surface of the midsole, and is connected between the midsole and the outsole;

a first girdle, wherein a bottom end of the first girdle is formed with two fork pieces so that an overall structure has a substantial Y-shape, end portions of the two fork pieces are fixed to a side edge of the midsole, a top end of the first girdle is adapted to go from one side of an arch portion of a foot bottom to a location above an instep, and a sticky piece is disposed on an outer surface of the first girdle; and a second girdle, which is in a form of a long sheet, wherein a bottom end of the second girdle is fixed to the other side edge of the midsole, a top end of the second girdle passes through the two fork pieces of the first girdle and then is adapted to go from the other side of the arch portion of the foot bottom to a location above the instep, and another sticky piece to be stuck with the sticky piece on the outer surface of the first girdle is disposed on an inner surface of a top end portion of the second girdle.

2. The shoe body according to claim 1, wherein the vamp comprises a first sidewall and a second sidewall adapted to cover two sides of the foot, the first sidewall has a first through hole penetrating through the first sidewall, the second sidewall has a second through hole penetrating through the second sidewall, an outer surface of the second sidewall is connected to a first additional sticky piece, the end portions of the two fork pieces of the first girdle are fixed to the side edge of the midsole close to the second sidewall, the top end of the first girdle extends outside the first sidewall from the first through hole, an inner surface of a top end portion of the first girdle is sewed with a second additional sticky piece to be stuck with the first additional sticky piece, the sticky piece on the outer surface of the first girdle is disposed on an outer surface of a portion of the first girdle extending outside the first sidewall, the bottom end of the second girdle is fixed to the side edge of the midsole close to the first sidewall, and the top end of the second girdle extends outside the second sidewall from the second through hole.

3. The shoe body according to claim 2, wherein the end portions of the two fork pieces of the first girdle are fixed to the side edge on a top surface of the midsole by way of sewing, and the bottom end of the second girdle is fixed to the other side edge on the top surface of the midsole by way of sewing.

4. The shoe body according to claim 2, wherein a hole edge of the first through hole of the first sidewall is connected to a first reinforcement member to strengthen a structural strength of a hole wall of the first through hole, and a hole edge of the second through hole of the second sidewall is connected to a second reinforcement member to strengthen a structural strength of a hole wall of the second through hole.

5. The shoe body according to claim 2, further comprising a shoe pad disposed in the vamp and above an overlapped portion between the first and second girdles.

6. The shoe body according to claim 1, wherein a bottom surface of the outsole is formed with front and rear ends, which are low, and a high middle to form a convex arc shape.

* * * * *